United States Patent [19]

Schmitt et al.

[11] 4,257,844

[45] Mar. 24, 1981

[54] PRESS SECTION ARRANGEMENT

[75] Inventors: Arnold J. Schmitt; Cornelius Rempel, both of Beloit, Wis.

[73] Assignee: Beloit Corporation, Beloit, Wis.

[21] Appl. No.: 21,911

[22] Filed: Mar. 19, 1979

Related U.S. Application Data

[63] Continuation of Ser. No. 787,925, Apr. 15, 1977, abandoned, which is a continuation of Ser. No. 694,473, Jun. 9, 1976, abandoned, which is a continuation of Ser. No. 583,288, Jun. 3, 1975, abandoned.

[51] Int. Cl.[3] ..... D21F 3/04

[52] U.S. Cl. ..... 162/305; 162/360 R

[58] Field of Search ..... 162/305, 306, 358, 360 R, 162/205; 29/116 AD

[56] References Cited

U.S. PATENT DOCUMENTS

| | | | |
|---|---|---|---|
| 3,198,695 | 8/1965 | Justus | 162/360 R X |
| 3,198,697 | 8/1965 | Justus | 162/358 X |
| 3,268,390 | 8/1966 | Ely, Sr. | 162/306 |
| 3,276,102 | 10/1966 | Justus | 29/116 AD |
| 3,595,745 | 7/1971 | Cronin | 162/306 |
| 3,861,996 | 1/1975 | Dorfel | 162/360 R X |
| 4,016,032 | 4/1977 | Kankaanpaa | 162/305 |
| 4,075,056 | 2/1978 | Ely et al. | 162/305 |
| 4,086,131 | 4/1978 | Rempel et al. | 162/305 X |
| 4,188,262 | 2/1980 | Kankaanpaa | 162/360 R |

*Primary Examiner*—William F. Smith

*Attorney, Agent, or Firm*—Hill, Van Santen, Steadman, Chiara & Simpson

[57] ABSTRACT

A paper machine press arrangement for receiving a paper web from a forming wire and carrying the web through at least two non-suction press nips and, for example, a dryer section. A first press nip is defined by a first grooved roll and a first controlled crown grooved roll. A second press nip is defined by a relatively large diameter plain press roll and a second grooved roll. In certain embodiments, a third non-suction press nip is included and is defined by the large diameter press roll and a second controlled crown grooved roll. A first felt wraps a suction pickup roll positioned in working relation to the forming wire and picks up the web on the underside of the felt and carries the web through at least two non-suction press nips. The second felt contacts the web prior to the first press nip and supports the web through the first press nip and is then guided downwardly away from the subsequent press nips so that any broke may be dumped without shutting down the machine or accumulating broke. The web is carried away from the second felt on the underside of the first felt with the aid of a suction transfer roll and is carried to the second non-suction press nip. The first felt is guided away from the web after the second press nip back to the forming wire. The web adheres to the outer surface of the plain press roll and is carried therefrom to a dryer or to the third non-suction press nip whereat a third felt contacts the web to guide the web through that work station. The third felt is then guided away from the web, while the web is appropriately directed for further processing, such as to a dryer section.

7 Claims, 4 Drawing Figures

PRESS SECTION ARRANGEMENT

This application is a continuation of our application, Ser. No. 787,925, filed Apr. 15, 1977, abandoned, which is a continuation of our earlier application, Ser. No. 694,473, filed June 9, 1976, abandoned, which is a continuation of our earlier application, Ser. No. 583,288, filed June 3, 1975 abandoned.

BACKGROUND OF THE INVENTION

The invention relates to paper machine press sections and somewhat more particularly to an arrangement which conveys a new web from a forming surface to dewatering press nips defined by non-suction press rolls which are capable of higher nip pressures and includes felts eliminating any open draws in the initial web path so as to convey the web through at least two press nips in a completely supported manner while permitting easy removal of broke.

PRIOR ART

Many paper machine web transfer and press arrangements are known. However, with increased modern-day high capacity paper machines capable of running at speeds in excess of 3000 to 7000 feet per minute and producing webs having a width in excess of 200 to 400 inches, presently known arrangements exhibit various drawbacks such as insufficient web support, insufficient dewatering capacity, inability to withstand the high-speed operational environment, inability to uniformly dewater a web, requiring excessive suction and/or energy, requiring excessive machine space, requiring excessive felt lengths, improper roll alignments for efficient web travel, etc.

For example, U.S. Pat. No. 2,694,347, suggests certain press sections which are useful at slower machine speeds. The press arrangements suggested by this reference rely on suction press rolls for adequate dewatering capacity. However, suction rolls are incapable of withstanding high nip pressures, are costly to produce and operate and are not well suited for high-speed operations.

U.S. Pat. No. 2,732,772 illustrates yet another prior art web transfer and press arrangement wherein dewatering at the various press nips occurs primarily through suction press rolls. Such arrangements are expensive to manufacture and operate and have insufficient dewatering capacity at modern-day speeds.

U.S. Pat. No. 2,869,437 suggestions yet another press arrangement which, while an improvement over the then existing prior art, nevertheless utilized numerous suction press rolls and involve one or more of the aforesaid drawbacks. Further, such suction rolls are subjected to corrosive environments and limit the allowable nip pressure which may be safely used, especially on wide web machines.

Other prior art web transfer and press arrangements are also known, for example, typical prior art arrangements are shown in U.S. Pat. Nos. 1,930,104; 2,204,446; 2,386,584; 2,764,068; 3,198,696; 3,268,390; 3,285,806; 3,315,637; 3,355,350; 3,595,745; etc. These arrangements have one or more of the drawbacks set forth above, especially in combination with high speed, wide web paper machines.

SUMMARY OF THE INVENTION

The invention provides an improved web transfer and press arrangement useful with high speed, wide web paper machines. A preferred arrangement of the invention includes a first felt which picks up a web from a forming surface, such as a wire, and conveys a web through at least two non-suction press nips. A second felt contacts the web prior to the first press nip, which is defined by an upper plain grooved press roll and a lower controlled crown grooved press roll. The two felts sandwich the web and provide a double-felted, double-vented first press nip which is operable at extremely high nip pressures. After the first press nip, the second felt is guided downwardly away from the web and subsequent press nips so that any broke can be directly dumped from the arrangement without requiring machine shutdown or movement of any machine components. A suction transfer roll is positioned downstream of the first press nip and guides the first felt with the web on the undersurface thereof to a second press nip, defined by an upper plain grooved press roll and a lower plain-surfaced press roll. The second press nip is a single-felted, single-vented dewatering nip and after such second nip, the first felt is guided back to the forming surface while the web adheres to the outer surface of the plain-surfaced press roll and is carried thereby to a further means for processing the web. In certain embodiments, such means include a third press nip defined by a plain-surfaced press roll and a controlled crown grooved press roll. In embodiments which include a third press nip, a third felt contacts the web prior to the third nip and passes therewith through such nip and then away from the web. The third press nip is also a single-felted, single-vented dewatering nip. After the third nip, the web is guided through a first open draw and then to a dryer section or the like. In certain embodiments, the controlled crown grooved press rolls may be replaced by a plain grooved press roll and/or the plain grooved press roll may be replaced by a controlled crown grooved press roll, depending on the economics of the situation.

It is a novel feature of the invention to provide press sections which are capable of adequately and economically processing wide webs at high operating speeds while achieving high water removal and sheet (web) quality, normally associated with heavily loaded suction press nips but without suction so as to provide lower capital and operating costs without sacrificing capacity and/or quality.

It is a further novel feature of the invention to provide non-suction press nips defined by at least one grooved roll, which may be plain or be provided with a controlled crown means in combination with either another grooved roll or a relatively large diameter plain-surfaced press roll having a sheet or web release surface, such as composed of granite, acrylic resin or other soft or hard plastic material compositions. Press nips of the invention which are defined by a pair of grooved rolls are double-felted and double-vented while press nips defined by a grooved roll in a plain press roll are single-felted and single-vented so that the sheet or web is protected and supported during the various press nips by felts and no open draws occur in the initial web path.

DESCRIPTION OF THE PREFERRED EMBODIMENTS

Figure 1:
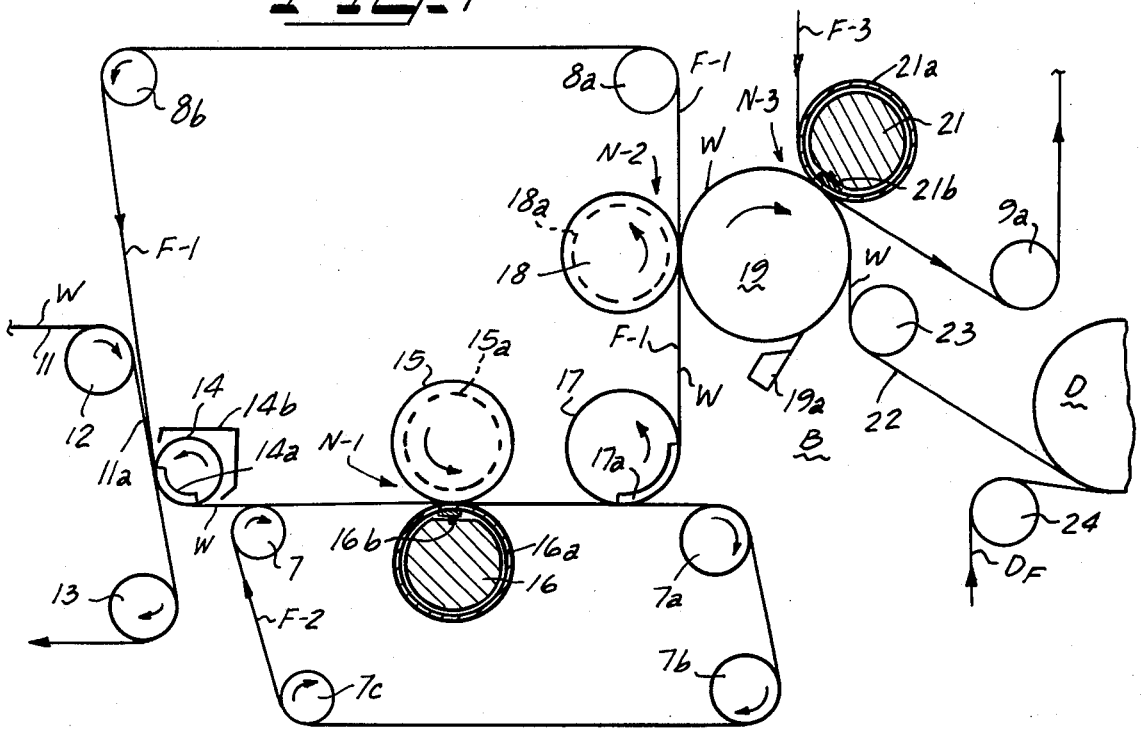
FIG. 1 is a somewhat schematic side elevational view illustrating an embodiment of a web transfer and press arrangement constructed in accordance with the principles of the invention.

The structural elements of a paper machine embodying the principles of the invention are shown schematically as has grown customary in the paper machine art and mechanical expedience for supporting and driving the rolls and associated machinery will be fully apparent to those versed in the paper making art and to which the present invention pertains. Similarly, paper machine elements which provide a practical working overall paper machine such as web forming sections or dryer sections, etc. have been omitted or only partially shown for the sake of simplicity but such elements will be fully apparent to those versed in the paper making art.

In the description and claims which follow, reference is made to on-coming or upstream and off-running or downstream directions and it will be understood that reference is made to the machine direction, which in the drawings runs from left to right.

The invention provides a compact, high-speed, high-capacity web transfer and press arrangement useful at modern-day high operating speeds in processing wide webs. Press arrangements constructed in accordance with the invention provide a double-felted, double-vented first press section which may be operated at extremely high nip pressures, well above allowable nip pressures of prior art plain press roll-suction roll press couples, particularly on wide web machines. Suction rolls are only used in the instant press arrangements to effect positive sheet or web transfer. In accordance with the principles of the invention, any nip pressure (psi) reduction which may result from double-felting is offset by the available nip pressure (pli) so as to achieve a much dryer sheet sheet going into a second press nip. The double-felted first press nip substantially eliminates two-sided water removal at the first press nip where most of the changes in the sheet quality occur. In preferred embodiments where a controlled crown grooved press roll forms a part of the first press nip, the controlled crown roll allows an operator to select optimum nip pressure for the grade of paper being produced.

A suction transfer of the sheet after the first press nip is provided to positively transfer the sheet to a single-felted, single-vented second press nip where higher unit pressures are provided to further dewater the sheet to yet a higher dryness level. Thereafter, the sheet is transferred to a plain press roll and either to a third, separately felted, Venta-Nip press (a registered trademark of Beloit Corporation for presses utilizing at least one grooved roll such as described in E. J. Justus U.S. Pat. No. 3,198,697, which is incorporated herein by reference) or to a dryer or other means for further processing the web. The third press nip may be provided as a final water removal step within the press section so as to provide a sheet having a maximum dryness level and a maximum moisture uniformity throughout the body thereof. Any broke from the second or third press nip is readily guided into a pulper or the like located below the press section without requiring a broke conveyor or means for accumulating broke.

In a paper machine such as partially illustrated at FIG. 1, a web W is formed at a forming section (not shown) on an endless traveling wire 11 (such as in a conventional Fourdrinier forming machine), which passes over and partially wraps a couch roll 12 (which may be a suction couch roll if desired) and then a turning roll 13 in a conventional manner. The wire run between the couch roll 12 and the turning roll 13 is designated as a pick-up run 11*a* and is preferably angled about 15° to 60° in an upward or downward direction so that the direction of web travel does not change excessively as it is removed from the wire 11 at the pick-up run 11*a*.

A traveling endless looped first felt F-1, sometimes designated as a transfer felt, is guided over a pick-up roll 14 having a suction gland 14*a* therein and into close running relation with the web W on the wire along the pick-up run 11*a*. The pick-up roll 14 urges the felt F-1 against the wet web W on wire 11 and effects transfer of the web from the wire to the felt via the suction gland 14*a*. A save-all 14*b* is positioned in close proximity to the off-running side of the suction gland 14*b* of pick-up roll 14 so as to substantially prevent droplets of water and the like from being thrown out of the roll perforations back on the top side of the felt F-1 and thus effect possible re-wetting of the felt F-1 and/or further re-wetting of the web W carried thereby. The felt F-1 is guided away from the pick-up run 11*a* and along a generally horizontal run as shown, although this felt run may be slightly inclined or declined, depending on the position of subsequent press rolls and other machine elements of a paper machine. The horizontal felt run generally terminates at suction transfer roll 17.

Endless looped felts comprise natural, synthetic or a combination of natural and synthetic fibers formed into felt loops of suitable size and water absorption characteristics and are trained over a plurality of guide and stretcher rolls. Such felt loops are arranged for conveying and protecting a web as it travels through a paper machine and for receiving water from the web as it is expressed or otherwise removed from the web via various elements of the paper machine. After the web is removed from a felt, the felt may be passed through suitable felt conditioning, cleansing and drying means of the type generally well known to those versed in the art and, accordingly, which are not shown herein.

As the web W travels downstream with the felt F-1 and in contact with the outer or undersurface of the felt F-1, a second felt F-2, sometimes designated as a press felt, is brought up beneath the web W and into supporting contact with the web by a guide roll 7. The web W is thus sandwiched between the felts F-1 and F-2 as it travels into a first press nip N-1. The second felt F-2 provides additional water-receiving means and aids in handling heavier webs so as to prevent such webs from separating from the outer or undersurface of felt F-1. If desired, the second felt F-2 may be heated, as by steam, prior to contact with the web W so as to render the felt F-2 more water-receptive and improve the transfer of water from the web to this felt. Typically, the felt F-1 and felt F-2 are of a felt weight in the range of about 2 to 5 ounces per square foot.

The sandwiched web is carried by felts F-1 and F-2 into the first press nip N-1 which is defined by a press couple comprised of rolls 15 and 16. In preferred embodiments of the invention, the press roll 15 may be provided with a plurality of circumferential grooves 15*a*, preferably of the type taught by E. J. Justun in U.S. Pat. No. 3,198,697 (which is incorporated herein by reference). The press roll 16 may be provided with a plurality of circumferentially extending grooves 16*a* and in preferred embodiments, roll 16 may also be provided with a means 16*b* for selectively adjusting the roll crown thereof, which is preferably constructed in accordance with the principles taught by E. J. Justus in U.S. Pat. No. 3,276,102 (which is incorporated herein by reference). For the sake of simplicity and in accordance with common usage, press rolls similar to press roll 15 will be referred to hereinafter and in the claims as a "plain groove roll" and press rolls similar to roll 16 will be referred to hereinafter and in the claims as a "controlled crown grooved roll". An operator may selectively activate the controlled crown grooved roll to provide a select nip pressure at the nip N-1 in accordance with the grade of paper being manufactured. Thus, the nip N-1 may be operated at uniform and extremely high nip pressures, well above those of a present-day Venta-Nip (a registered trademark of Beloit Corporation for a grooved press roll shell of the type taught by E. J. Justus in U.S. Pat. No. 3,198,697) press, which may be comprised of a plain grooved roll and a suction roll combination. In certain other more economical embodiments where the full potential benefit of controlled crown grooved rolls, taking into consideration machine speed, machine width, paper grade, required nip pressure, etc. is not required or not justified in relation to the cost of such controlled crown grooved rolls, such rolls may be replaced by plain grooved pressed rolls.

Since the web W is sandwiched between the felts F-1 and F-2 as it passes through the nip N-1, the nip is referred to hereinafter as a "double-felted nip". Further, since both press rolls 15 and 16 are grooved rolls which are vented to atmosphere, the nip N-1 is also referred to hereinafter as a "double-vented nip". Accordingly, the nip N-1 is a double-felted, double-vented nip which may be designed to operate at extremely high nip pressures. Any reduction of nip pressure (psi) resulting from double-felting, is readily offset by the available nip pressure (pli) so as to achieve a much drier sheet or web being fed to a second press nip. Further, by eliminating suction rolls and their auxiliary equipment, a substantial savings is realized in capital outlay and in operating costs. In addition, a double-felted, first press nip substantially eliminates two-sided water removal from the web or sheet at such nip, where most of the changes in sheet quality occur. Water expressed at the nip N-1 is carried away from the felt-web-felt structure via the grooves in rolls 15 and 16, respectively.

As the sandwiched felt-web-felt structure passes beyond the nip N-1, a suction transfer roll 17 and a guide roll 7*a* positioned within the loops of the respective felts F-1 and F-2 combine to guide the felts and web in a substantially straight line path which is tangential to the outer peripheries of rolls 15 and 16. This effectively prevents rewetting of the felts and/or web by water within rolls 15 and 16. Auxiliary equipment, such as wipers, savealls, doctors, etc., may be associated with the rolls 15 and 16 to assist in water control and to prepare the individual roll surfaces for renewed intake of water.

The guide roll 7*a* is wrapped by felt F-2 so as to guide the felt downwardly and away from the web and remaining press nips of the arrangement and through its endless loop via a plurality of guide rolls such as 7*b*, 7*c*, etc.

The felt F-1 wraps the suction transfer roll 17 and the web W adheres to the outer surfaces thereof with the aid of suction gland 17*a* within roll 17. It will be noted that the suction gland 17*a* extends a distance substantially equal to the lower up-running quadrant of roll 17. This effectively transfers the sheet or web W from the felt F-2 and allows the web to undergo an approximately 90° change of travel direction without departing from the felt F-1.

The felt F-1 and web W then continue traveling in a substantially straight-line path upwardly to a second press nip N-2. In preferred embodiments of the invention, the press nip N-2 is defined by a plain grooved press roll 18 within the loop of the felt F-1 and a relatively large diameter plain-surfaced roll 19, positioned outside the loop of the felt F-1. The plain grooved press roll may be of the type described earlier and the plain-surfaced roll 13 is of a larger diameter than either of the grooved rolls 15, 16 or 18 and has a smooth outer surface composed of a material having web or sheet releasing characteristics and is preferably selected from the group consisting of granite, acrylic resin and other natural or synthetic, soft or hard compositions, which for the sake of economy may be provided as roll covers on an economical roll core. The nip N-2 may be termed a single-felted, single-vented Venta-Nip (a registered trademark of Beloit Corporation) second press nip which is capable of producing higher unit pressures to further dewater the sheet or web to a higher dryness level. If desired, the pressure roll 18 may be a controlled crown grooved press roll having grooves 18*a*. After the nip N-2, the felt F-1 continues to travel upwardly in a substantially straight-line path to guide roll 8*a* and then to wrap the guide roll 8*a* and travel back through its loop via a plurality of guide rolls such as guide roll 8*b*, etc.

The web W adheres to the outer surface of the plain-surfaced roll 19 because of its more dense surface in relation to the felt F-1. In the embodiment shown at FIG. 1, the web remains in contact with the plain-surfaced roll at least until the roll surface carries the web to a third press nip N-3. As the web W enters the nip N-3, it is contacted on its outer surface by a third felt F-3, sometimes designated as a press felt. The felt F-3 travels through an endless loop on a plurality of guide rolls, only one of which is shown, i.e. guide roll 9*a*. The nip N-3 is preferably defined by a controlled crown grooved roll 21 and the plain-surfaced press roll 19. In preferred embodiments, the roll 21 includes a plurality of circumferentially extending grooves 21*a* along the outer peripheral surface thereof and a shoe means 21*b* for selectively providing an adjustable crown to roll 21 and a select amount of nip pressure on the web. However, in other embodiments the roll 21 may comprise a plain grooved press roll of the type earlier described. The nip N-3 is also a single-felted, single-vented press nip and provides a final water removal station for the web and results in a maximum dryness level of the web and maximum moisture uniformity within the body of the sheet or web. In order to minimize machine space requirements, the second and third press nips N-2 and N-3 respectively, are spaced apart about 45° to 120° on the periphery of a common plain-surfaced press roll. Auxiliary equipment, such as wipers, savealls, doctors, etc. may be associated with rolls 18, 19 and/or 21 to assist in water control and to prepare the individual roll surfaces for renewed intake of water.

After the nip N-3, the felt F-3 is guided tangentially away from the surfaces of rolls 19 and 21 as well as away from the web W, which continues to adhere to the surface of the plain-surfaced roll 19 for a short distance and is then guided across a first open draw 22 and to a means for further processing of the web, such as a plurality of dryer drums D. A draw roll 23 is positioned to contact the web in the open draw area and provide support therefor as an aid in preventing undue fluttering or the like. A felt $D_F$, sometimes designated as a dryer felt, is guided via roll 24 into contact with the web so as to support the web in its serpentine path of travel over various dryer drums. Of course, if desired, the dryer section may be displaced by other processing means, such as a smoothening press or other means.

The felts passing through the various press nips, i.e. F-1, F-2 and F-3 as well as their respective guide rolls are so arranged as to provide an unobstructed open space B which extends at least below the suction transfer roll 17 and plain press roll 19 and allows any broke or the like to be readily dumped through the open draw 22 and into a pulper (not shown) located in the basement without requiring machine shut-down or the movement of any machine elements or accumulation of any portion of the broke. A doctor blade 19*a* is mounted in working relation with the down-running surface of roll 19 and prevents the web or any portion thereof from following around the roll 19, which might cause operational problems. The doctor blade separates any broke or the like from the surface of roll 19 in the event of web breakage and dumps it into the open space B. It will be appreciated that at high machine speeds, any web, especially a wide web, will produce a considerable volume of broke in a relatively short time period and that considerable time may be required to correct the problems which cause the broke and to re-thread the web. The felt and press roll arrangement shown allows any desired amount of broke or the like to be quickly and permanently removed from the paper machine without movement of any machine components.

It will be noted that as the web W travels from the forming section through the press section and into, for example, the dryer section in the arrangement illustrated at FIG. 1, the "wire side" of the web, i.e. that surface of the web that was in direct contact with the forming surface, is successively pressed or smoothened at the various press nips, particularly nips N-2 and N-3, against smooth-surfaced press rolls to remove any wire or the like markings therefrom.

Figure 2:
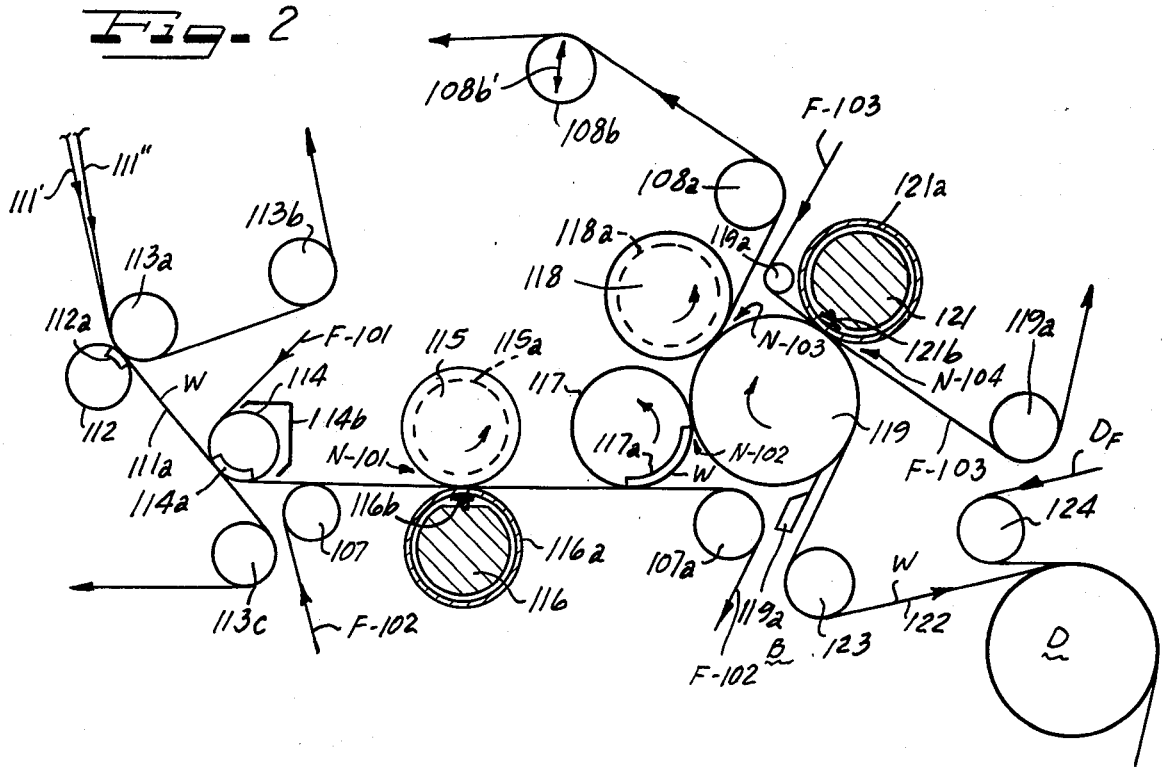
FIG. 2 is a somewhat similar view of another embodiment constructed in accordance with the principles of the invention.

The arrangement illustrated at FIG. 2 is somewhat similar to that of FIG. 1 so that like elements are designated with reference characters similar to such elements in FIG. 1, except that they are in the 100 series. Thus, a web W is formed on a forming section which may be comprised of a pair of endless looped foraminous forming wires 111' and 111'' which are trained over suitable guides and dewatering means (not shown) so as to receive web-forming stock therebetween, dewater such stock sufficiently to form an insipient web at least by the time the wires reach a couch roll 112. Further details of such forming section may be obtained from J. D. Parker et al U.S. Pat. No. 3,726,758, which is incorporated herein by reference. Of course, other forming sections may also be utilized.

As shown, a wire turning roll 113*a* positioned opposite the couch roll 112 is at least partially wrapped by both wires 111' and 111'' so as to protect the insipient web during the change of travel direction that occurs at that point. The suction gland 112*a* of couch roll 112 extends from a point just prior to the contact point thereof with roll 113*a* to a point just downstream thereof so as to effectively transfer the web W to the outer surface of wire 111'. The other wire 111'' wraps roll 113*a* and is guided via a plurality of guide rolls, such as roll 113*b*, back through its loop in a conventional manner. Wire 111' continues to travel in a downwardly angular direction to a turning roll 113*c* which, in combination with other guide rolls, effectively guides wire 111' through its loop.

The web W is transferred from the outer surface of wire 111' along the pick-up run 111*a* by a first felt F-101 which is guided into close running web transfer relation with the wire 111' by a pick-up roll 114 which has a suction gland 114*a* to cause the wet web W to follow the felt F-101 and travel therewith along a substantially horizontal run into a multi-nip press section.

The basic arrangement of this press section is substantially similar to that shown in FIG. 1 and reference is made to that discussion for a more detailed explanation of the various elements.

One important difference between the arrangements of FIGS. 1 and 2 is that in FIG. 2, the suction transfer roll 117 within the loop of felt F-101 is positioned so as to be in nip-defining relation with the plain-surfaced press roll 119. In this manner, the suction transfer roll 117 is lightly nipped against the surface of the plain-surfaced press roll 119 and prevents blowing or the like thereby insuring more positive web or sheet control. In addition, this type of arrangement is somewhat more compact than that shown at FIG. 1 and requires less machine space.

Figure 3:
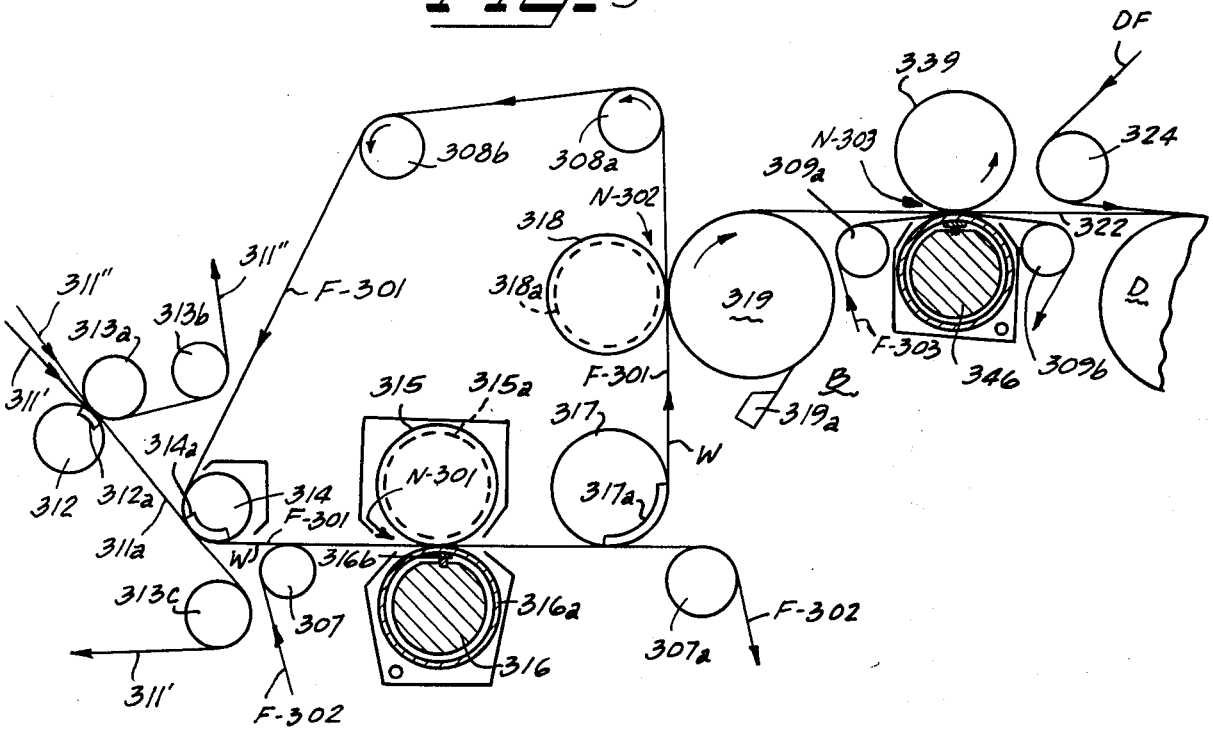
FIG. 3 is a similar view of yet another embodiment constructed in accordance with the principles of the invention.

In the embodiment illustrated at FIG. 3, elements similar to those in FIGS. 1 and 2 are designated with identical reference characters, except that they are in the 300 series.

Generally, the basic arrangement of this press section is, at least through the nip N-302, substantially similar to that shown in FIG. 1 through nip N-2 so that the reader may refer to that discussion for a more detailed explanation of the various elements.

One important difference between the arrangements of FIGS. 1 and 3 is that in FIG. 3 the third press nip N-303 is defined by an upper plain-surfaced press roll 339 (which may be substantially similar to rolls 19 or 319) and a lower controlled crown grooved press roll 346 (which may be substantially similar to rolls 16, 21 or 316). In such an arrangement, the sheet side opposite to the side in contact with roll 319 is pressed to remove any objectionable surface markings or the like therefrom. In addition, this form of a third press nip, i.e. nip N-303, is provided with a felt F-303 along the bottom thereof for easier water removal as well as providing a second pressing operation on the bottom of the web (rolls 315 and 318 provide a pressing operation on the top of the web and roll 316 provides a first pressing operation on the bottom of the web). In this manner, the sheet obtained from an arrangement as shown in FIG. 3 is of somewhat higher quality.

Figure 4:
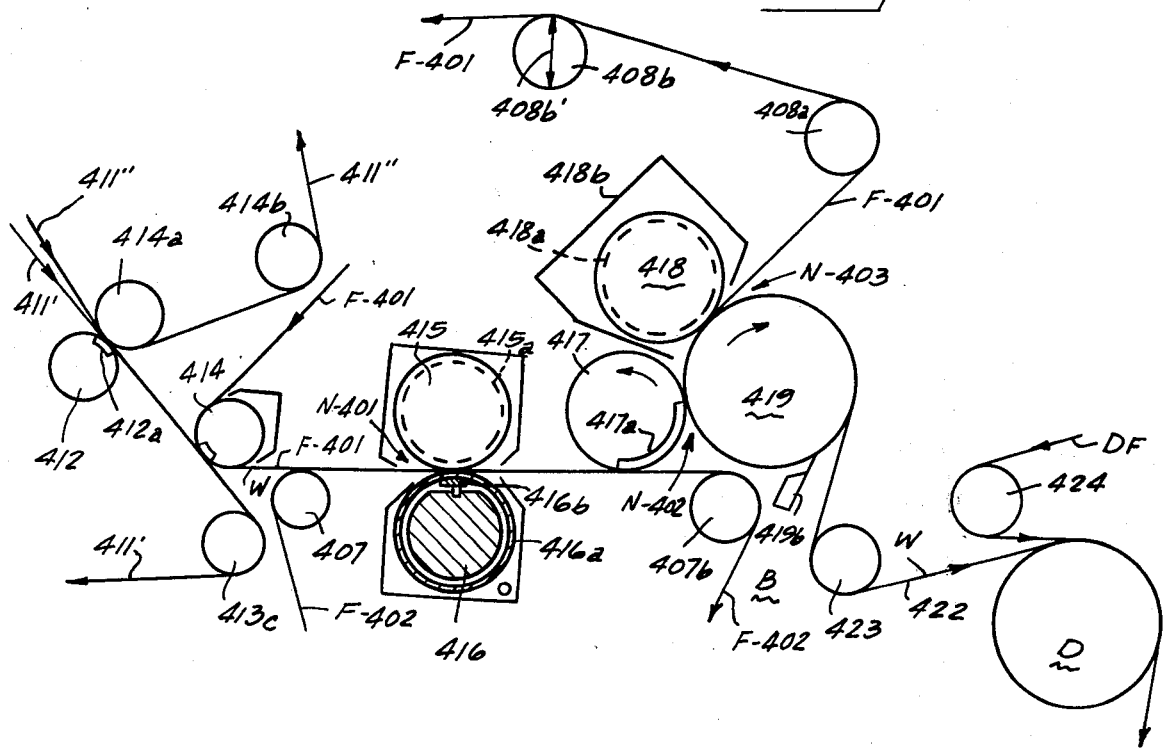
FIG. 4 is a somewhat similar view of a further embodiment constructed in accordance with the principles of the invention.

The arrangement illustrated at FIG. 4 is somewhat similar to that of FIGS. 1, 2 and 3 so that like elements are designated with similar reference characters, except that they are in the 400 series. As can be seen, the basic arrangement of this press section is, at least through nip N-403, similar to that shown in FIG. 2 so that reference may be had to that discussion for a more detailed explanation of the various elements and their functions.

One important distinction between the arrangements of FIGS. 2 and 4 is that in the arrangement of FIG. 4, only two press nips, N-401 and N-402, are utilized. This arrangement is thus suited for the production of certain paper grades which do not require a third press nip to yield sufficiently dry high quality paper.

The web transfer and press arrangement of the invention is capable of high speed operation and of satisfactorily handling wide webs with a uniform removal of substantially more water therefrom than possible with more conventional suction rolls. Further, the capital outlay and operating costs of such an arrangement are considerably lower because of the elimination of larger suction rolls, vaccum pumps and other associated equipment. In addition, the substantially imperforated rolls utilized in the various press couples in the illustrated arrangement are substantially impervious to the corrosive environment typically found on a paper machine and may be safely loaded to nip pressures substantially above those available with perforated or suction rolls. Accordingly, the web transfer and press arrangements constructed in accordance with the principles of the invention are exceptionally suited for modern-day wide paper machines.

The basic press arrangement provided by the invention is extremely versatile since the first, second and, where desired, the third press nips thereof may be respectively defined by an upper plain grooved press roll and a first grooved press roll, a relatively large diameter plain-surfaced press roll and a second grooved press roll, and the plain-surfaced press roll and a third grooved press roll. In one variation of the press arrangement provided by the invention, the first, second and third grooved press rolls may comprise plain grooved press rolls; in another variation the first, second and third grooved press rolls may comprise controlled crown grooved press rolls; and yet in another variation the first, second and third grooved press rolls may comprise press rolls selected from the group consisting of plain grooved press rolls, controlled crown press rolls and mixtures thereof. Similarly, the basic press arrangement may be readily converted to a three nip or a two nip structure as desired without undue difficulty. Each of these variations have an economical and/or functional advantage and provide a user thereof with an option of converting from one variation to another without requiring a complete restructuring of the basic press arrangement.

The drawings and specification present a detailed disclosure of certain preferred embodiments of the invention, and it is to be understood that the invention is not limited to the specific form disclosed, but covers all modifications, changes and alternative constructions and methods falling within the scope of the principles taught by the invention.

We claim as our invention:

1. In a paper machine, the combination comprising:

a forming wire traveling over a couch roll to a turning roll in a pickup run and carrying a web on its outer surface;

an upper first looped felt traveling over a pickup roll and in close running relation with said wire at said pickup run to pick off said web from said wire and carry said web from said wire on an outer surface of said felt;

a lower second looped felt traveling over a first guide roll and into supporting contact with a lower surface of said web as said web is being carried by said first felt;

a first high pressure press nip positioned in working relation to said first and second felts carrying the web therebetween, said first press nip being defined by an upper first roll within the first felt downstream from the pickup roll and a lower second grooved press roll within the second felt downstream from said first guide roll;

a suction transfer means positioned within the loop of said first felt following said first press nip so as to guide the web to follow the first felt away from said second felt;

a second guide means positioned within the loop of said second felt downstream of said first press nip positioned so as to guide said second felt in continuous supporting contact with the web until the web is transferred to the first felt;

a second press nip positioned after the transfer means receiving said first felt carrying the web, said second press nip being defined by a grooved third press roll within the loop of said first felt and a plain-surfaced fourth press roll in direct contact with the web carried by said first felt, said web being carried on the peripheral surface of said plain-surfaced press roll from said second nip;

a third guide roll positioned within the loop of said first felt downstream of said second press nip so as to guide said first felt away from said second press nip and away from said plain-surfaced press roll;

a third press nip defined between said plain surfaced roll and a fifth press roll and receiving the web after said second press nip;

a third felt passing through said third nip with said web; and means for removing the web from said plain-surfaced roll after said third nip.

2. In a paper machine constructed as defined in claim 1:

wherein said lower second grooved press roll is in the form of a hollow roll shell with a stationary shaft therein and deflection control means between the shaft and roll shell.

3. In a paper making machine, the structure defined in claim 1:

wherein said second nip is positioned substantially directly vertically above said suction transfer means.

4. In a paper machine constructed in accordance with claim 1:

wherein said fifth press roll has a grooved outer surface.

5. In a paper machine constructed in accordance with claim 4:

wherein said third felt wraps said fifth press roll.

6. In a paper machine constructed as set forth in claim 4:

wherein said fifth press roll has a series of circumferential grooves in the surface thereof.

7. In a paper machine, the combination comprising:

a forming wire traveling over a couch roll and carrying a web on its outer surface;

an upper first looped felt traveling over a pick-up means and in close running relation with said wire to pick off said web from said wire and carry said web from said wire on an outer surface of said felt;

a lower second looped felt traveling over a first guide roll and into supporting contact with a lower surface of said web as said web is being carried by said first felt;

a first high pressure press nip positioned in working relation to said first and second felts carrying the web therebetween, said first press nip being defined by an upper first and a lower second grooved press roll, said upper first and said lower second press rolls being positioned downstream from said pickup means;

a suction transfer roll positioned within the loop of said first felt downstream of said first press nip so as to transfer the web to said first felt with said first felt and web following said transfer roll away from said second felt;

a second guide roll positioned within the loop of said second felt downstream of said first press nip positioned so as to guide said second felt horizontally in continuous supporting contact with the web until the web is transferred to the first felt;

a second press nip defined between said transfer roll and a relatively large diameter plain surfaced third press roll in direct contact with the web carried by the first felt;

a third press nip formed between said third press roll and a fourth press roll, said fourth press roll positioned within said first felt with the web and first felt passing through said third nip;

and means for receiving the web from the offrunning side of said plain-surfaced third press roll.

* * * * *